US011662136B2

(12) United States Patent
Lottinville et al.

(10) Patent No.: US 11,662,136 B2
(45) Date of Patent: May 30, 2023

(54) APPLIANCE HINGE ASSEMBLY

(71) Applicant: WHIRLPOOL CORPORATION, Benton Harbor, MI (US)

(72) Inventors: Daniel Lottinville, Stevensville, MI (US); Lynne F Hunter, Dorr, MI (US); Karen J. Querfurth, Coloma, MI (US); Aaron M. Stewart, Buchanan, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 17/047,451

(22) PCT Filed: May 23, 2018

(86) PCT No.: PCT/US2018/034085
§ 371 (c)(1),
(2) Date: Oct. 14, 2020

(87) PCT Pub. No.: WO2019/226158
PCT Pub. Date: Nov. 28, 2019

(65) Prior Publication Data

US 2021/0148628 A1 May 20, 2021

(51) Int. Cl.
*F25D 23/02* (2006.01)
*F25D 23/06* (2006.01)

(52) U.S. Cl.
CPC ..... *F25D 23/028* (2013.01); *F25D 23/062* (2013.01); *F25D 23/065* (2013.01); *E05Y 2900/31* (2013.01); *F25D 2323/021* (2013.01); *F25D 2323/024* (2013.01)

(58) Field of Classification Search
CPC .... F25D 23/065; F25D 23/064; F25D 23/066; F25D 23/067; F25D 23/062; F25D 2323/024; F25D 2400/06; E05Y 2900/31
See application file for complete search history.

(56) References Cited

U.S. PATENT DOCUMENTS 1,588,707 A * 6/1926 Csiga ..... F25D 23/06 220/592.27
1,948,587 A 2/1934 Macready et al.
2,065,608 A 12/1936 Munters
(Continued)

FOREIGN PATENT DOCUMENTS

CN 1070979 A 4/1993
CN 1287257 A 3/2001
(Continued)

*Primary Examiner* — Hiwot E Tefera
(74) *Attorney, Agent, or Firm* — Price Heneveld LLP

(57) ABSTRACT

A cabinet structure includes a wrapper defining an opening. At least one liner is positioned inside the opening of the wrapper and defines a temperature-controlled compartment. An insulation cavity is defined between the wrapper and the liner. A trim breaker is coupled to the wrapper and the liner. A first hinge bracket is positioned outwardly of the trim breaker. An encapsulation member is positioned rearwardly of the trim breaker and defines an encapsulation cavity. A first hinge support has a first section positioned along a second hinge support and a second section extending rearwardly from the first section. The first hinge bracket is coupled to the first and second hinge supports.

7 Claims, 12 Drawing Sheets

(56) References Cited

U.S. PATENT DOCUMENTS

RE21,364 E 2/1940 Lipman
3,917,206 A 11/1975 Fisher
4,170,391 A * 10/1979 Bottger ..... E05D 3/04 248/222.11
4,550,576 A * 11/1985 Tate, Jr. ..... F25D 23/069 62/441
4,557,537 A * 12/1985 Greer ..... H01R 4/64 29/256
4,558,503 A * 12/1985 Wilson ..... B23P 15/26 29/446
4,606,112 A * 8/1986 Jenkins ..... F25D 23/062 29/464
4,632,470 A * 12/1986 Jenkins ..... F25D 23/062 29/525.12
4,706,363 A * 11/1987 Taylor, Jr. ..... F25D 23/067 29/453
5,052,151 A * 10/1991 Inui ..... E05D 15/505 292/79
5,064,255 A * 11/1991 Inui ..... F25D 23/02 49/504
5,222,792 A * 6/1993 Kai ..... E05D 15/502 312/406
5,720,536 A * 2/1998 Jenkins ..... F25D 23/085 312/401
7,517,031 B2 4/2009 Laible
8,197,019 B2 6/2012 Kim
8,491,070 B2 7/2013 Davis et al.
8,752,921 B2 6/2014 Gorz et al.
8,764,133 B2 7/2014 Park et al.
8,899,068 B2 * 12/2014 Jung ..... F25D 23/066 62/440
2004/0012315 A1 * 1/2004 Grace ..... F25D 23/062 312/406
2009/0284116 A1 * 11/2009 Gorz ..... F25D 23/062 312/405
2010/0219732 A1 * 9/2010 Gorz ..... F25D 23/064 312/405
2011/0095669 A1 * 4/2011 Moon ..... F25D 23/06 29/890.035
2013/0257257 A1 * 10/2013 Cur ..... F25D 23/066 156/286
2015/0159937 A1 * 6/2015 Jang ..... B32B 17/061 428/630
2017/0003070 A1 * 1/2017 Alshourbagy ..... F25D 23/04
2017/0184341 A1 * 6/2017 Grimm ..... F25D 21/04
2019/0162356 A1 * 5/2019 Allard ..... F16L 59/065

FOREIGN PATENT DOCUMENTS

CN 101663552 A 3/2010
CN 102525139 A 7/2012
CN 202361736 U 8/2012
CN 104019597 A 9/2014
CN 104898315 A 9/2015
CN 105637307 A 6/2016
CN 105829630 A 8/2016
WO 2018022007 2/2018
WO 2018067108 A1 4/2018

* cited by examiner

APPLIANCE HINGE ASSEMBLY

CROSS-REFERENCE TO RELATED APPLICATIONS

This application claims priority to International Application No. PCT/US2018/034085, filed on May 23, 2018, entitled "APPLIANCE HINGE ASSEMBLY" the disclosure to which is hereby incorporated herein by reference in its entirety.

BACKGROUND

The present device generally relates to insulated structures, in particular, to a vacuum insulated refrigerator cabinet structure that includes a door hinge bracket coupled thereto.

SUMMARY

In some aspects, a cabinet structure is provided herein that includes a wrapper defining an opening. At least one liner is positioned inside the opening of the wrapper and defines a temperature-controlled compartment. An insulation cavity is defined between the wrapper and the liner. A trim breaker is coupled to the wrapper and the liner. A first hinge bracket is positioned outwardly of the trim breaker. An encapsulation member is disposed rearwardly of the trim breaker and defines an encapsulation cavity. A first hinge support has a first section positioned along a second hinge support and a second section extending rearwardly from the first section. The first hinge bracket is coupled to the first and second hinge supports.

In some aspects, a cabinet structure is provided herein that includes a wrapper spaced apart from a liner. A trim breaker is coupled to the wrapper and the liner. An insulation cavity is positioned between the wrapper, the liner, and the trim breaker. An encapsulation member is positioned rearwardly of the trim breaker and defines an encapsulation cavity that is separated from the insulation cavity. A first hinge support is positioned laterally outward of a second hinge support. The first and second hinge supports are each coupled with a first hinge bracket.

In some aspects, a cabinet structure is provided herein that includes a wrapper spaced apart from a liner. A trim breaker is coupled to the wrapper and the liner. An insulation cavity is defined between the wrapper, the liner, and the trim breaker. A hinge bracket has at least one fastener inserted therethrough, the fastener positioned externally from the insulation cavity.

These and other features, advantages, and objects of the present device will be further understood and appreciated by those skilled in the art upon studying the following specification, claims, and appended drawings. Moreover, any of the aspects provided herein may be combined and/or removed without departing from the scope of the present disclosure.

DETAILED DESCRIPTION OF EMBODIMENTS

Figure 1:
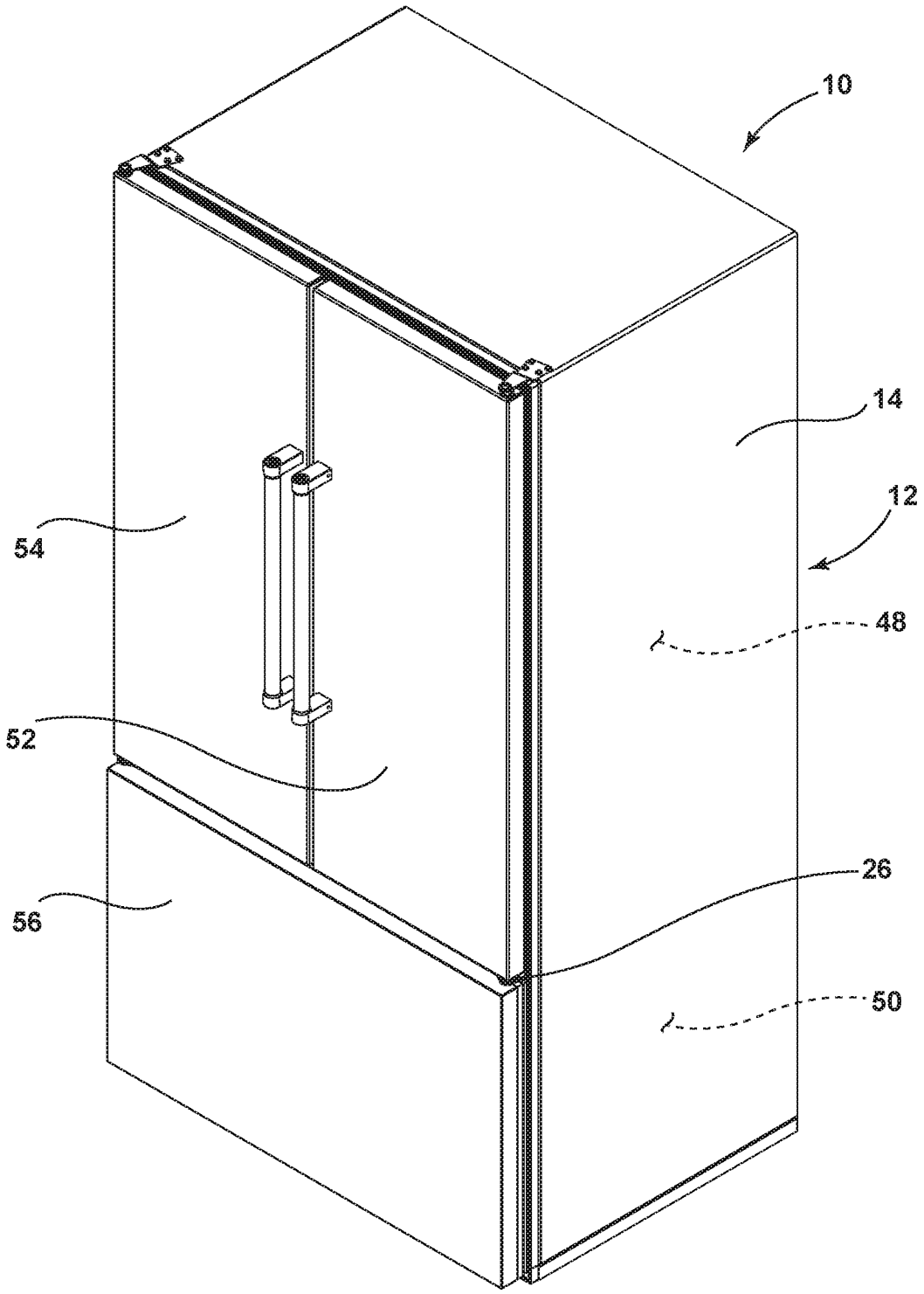
FIG. 1 is a front perspective view of a refrigerator, according to some examples.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations, except where expressly specified to the contrary. It is also to be understood that the specific devices and processes illustrated in the attached drawings, and described in the following specification are simply exemplary examples of the inventive concepts defined in the appended claims. Hence, specific dimensions and other physical characteristics relating to the examples disclosed herein are not to be considered as limiting, unless the claims expressly state otherwise.

As required, detailed examples of the present invention are disclosed herein. However, it is to be understood that the disclosed examples are merely exemplary of the invention that may be embodied in various and alternative forms. The figures are not necessarily to a detailed design and some schematics may be exaggerated or minimized to show function overview. Therefore, specific structural and functional details disclosed herein are not to be interpreted as limiting, but merely as a representative basis for teaching one skilled in the art to variously employ the present invention.

In this document, relational terms, such as first and second, top and bottom, and the like, are used solely to distinguish one entity or action from another entity or action, without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises . . . a" does not, without more constraints, preclude the existence of additional identical elements in the process, method, article, or apparatus that comprises the element.

As used herein, the term "and/or," when used in a list of two or more items, means that any one of the listed items can be employed by itself, or any combination of two or more of the listed items can be employed. For example, if a composition is described as containing components A, B, and/or C, the composition can contain A alone; B alone; C alone; A and B in combination; A and C in combination; B and C in combination; or A, B, and C in combination.

With reference to FIGS. 1-15, a refrigerator 10 includes a cabinet structure 12 having a wrapper 14 defining an opening 16. At least one liner 18, 20 is positioned inside the opening 16 of the wrapper 14 and defines at least one temperature-controlled compartment 48, 50. An insulation cavity 22 is defined between the wrapper 14 and the liner 18, 20. A trim breaker 24 is coupled to the wrapper 14 and the liner 18, 20. A first hinge bracket 26 may be positioned outwardly of the trim breaker 24. An encapsulation member 28 is positioned rearwardly of the trim breaker 24 and defines an encapsulation cavity 30. A first hinge support 32 has a first section 34 positioned along a second hinge support 36 and a second section 38 extending rearwardly of the first section 34. The first hinge bracket 26 is operably coupled with the first and second hinge supports 32, 36. A second hinge bracket 40 may be positioned on an opposing side of a temperature-controlled compartment 48, 50. A second hinge bracket 40 may be operably coupled with an externally positioned brace 42. The brace 42 may be fixed to a plate 44. The plate 44 extends laterally across an exterior portion 46 of the wrapper 14.

Referring now to FIG. 1, the refrigerator 10 includes the insulated cabinet structure 12 that may define the temperature-controlled compartment 48, 50, such as a refrigerator compartment 48 and/or a freezer compartment 50. One or more refrigerator compartment doors 52, 54 are provided to selectively provide access to the refrigerator compartment 48, while one or more freezer compartment doors 56 may be used to provide access to the freezer compartment 50. The configuration of the refrigerator 10 illustrated in FIG. 1 is exemplary only and the present concept is contemplated for use in all refrigerator styles including, but not limited to, side-by-side refrigerators, whole refrigerator and freezers, and refrigerators with upper freezer compartments. Additionally, the one or more refrigerator compartment doors 52, 54 and/or one or more freezer compartment doors 56 may be hingedly attached to the cabinet structure 12 and/or slidably attached to the cabinet structure 12 without departing from the teachings provided herein. It will also be appreciated that the assemblies provided herein may be used in any other appliance and/or cabinet structure 12 without departing from the scope of the present disclosure.

Figure 2:
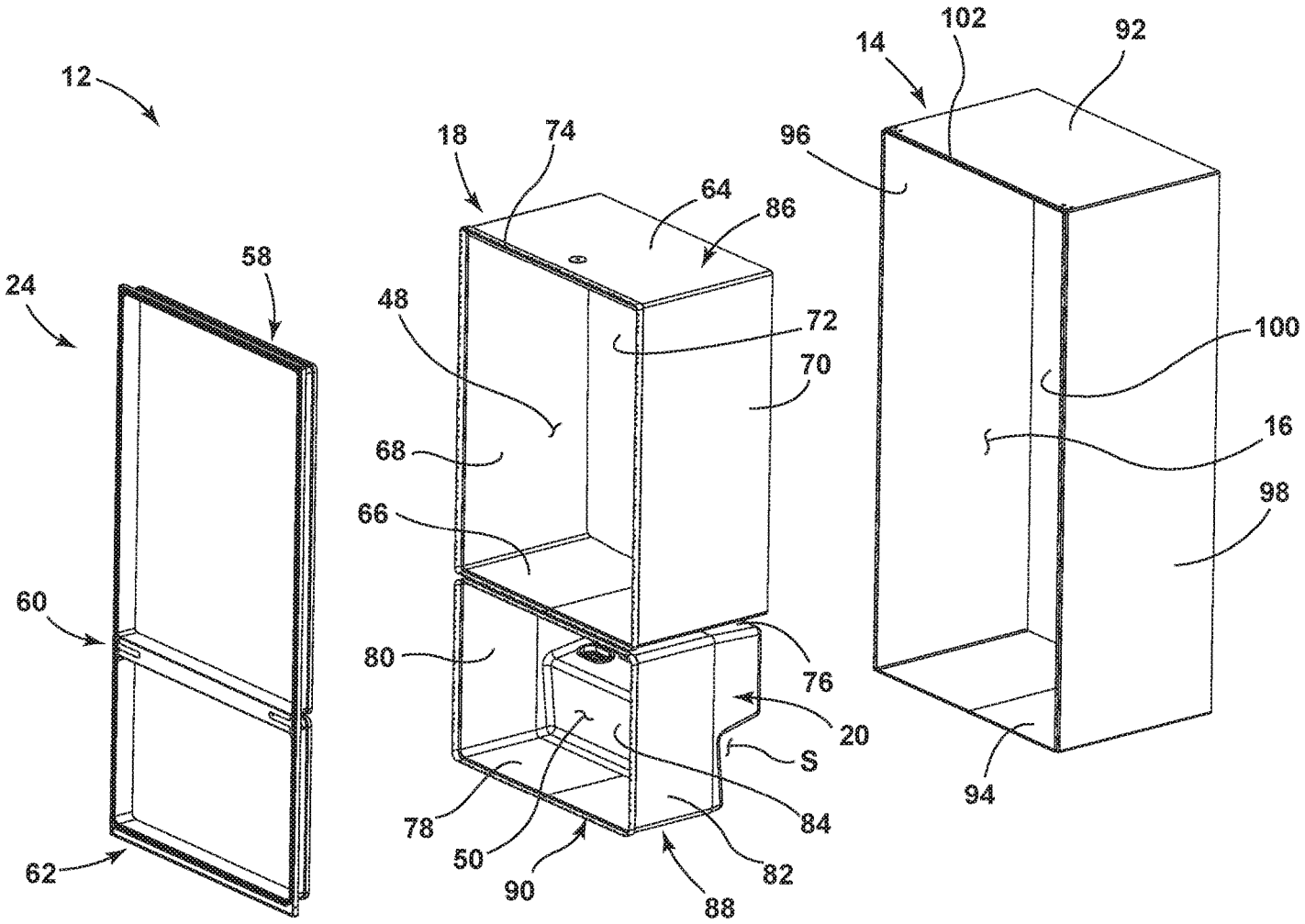
FIG. 2 is an exploded front perspective view of an insulated refrigerator cabinet structure, according to some examples.
Figure 3:
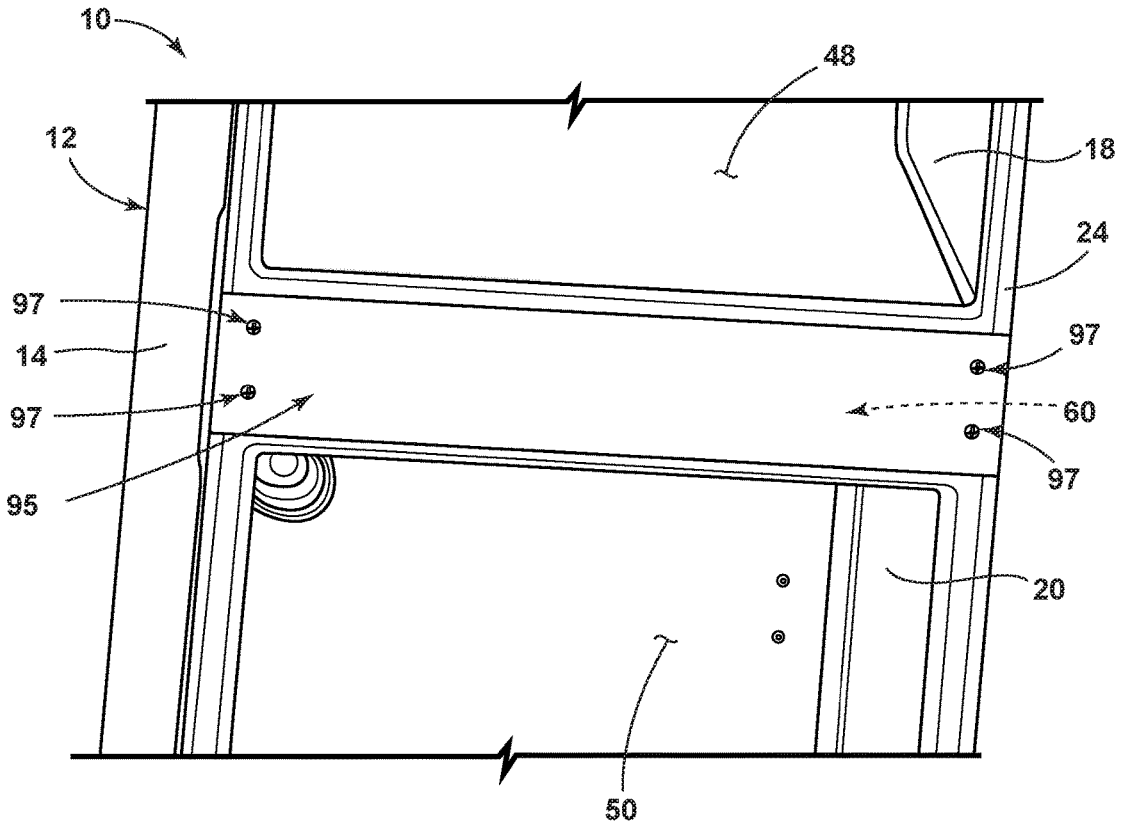
FIG. 3 is a front perspective view of a cover assembly positioned over a central portion of the trim breaker, according to some examples.

With reference to FIG. 2, the insulated cabinet structure 12 may also include the trim breaker 24 that includes an upper portion 58, a central portion 60, and a lower portion 62. In examples in which the refrigerator compartment 48 includes the refrigerator liner 18, the refrigerator liner 18 has a top wall 64, bottom wall 66, opposed sidewalls 68, 70, and a rear wall 72 which cooperate to define the refrigerator compartment 48. The refrigerator liner 18 further includes a front edge portion 74 positioned on a front portion of the refrigerator compartment 48.

Similarly, in examples that include a freezer compartment 50, the freezer liner 20 includes a top wall 76, a bottom wall 78, opposed sidewalls 80, 82, and a rear wall 84, which all cooperate to define the freezer compartment 50. The rear wall 84 may be a contoured rear wall that provides a spacing S for housing cooling components for cooling the refrigerator compartment 48 and/or the freezer compartment 50. Such components may include a compressor, a condenser, an expansion valve, an evaporator, a plurality of conduits, and other related components used for cooling the refrigerator and/or freezer compartments 48, 50. The freezer liner 20 further includes a front edge portion 90 positioned at a front portion of the freezer compartment 50, which is positioned along the top wall 76, the bottom wall 78 and the opposed sidewalls 68, 70. In assembly, the front edge portion 74 of the refrigerator liner 18 and the front edge portion 90 of the freezer liner 20 are configured to couple with the trim breaker 24.

As further shown in FIG. 2, the insulated cabinet structure 12 further includes the wrapper 14 which includes a top wall 92, a bottom wall 94, opposed sidewalls 96, 98, and a rear wall 100 which cooperate to define the opening 16. The wrapper 14 further includes a front edge portion 102 that defines a front portion of the opening 16. In assembly, the front edge portion 102 of the wrapper 14 is coupled to the trim breaker 24 around the liners 18, 20. Further, the refrigerator liner 18 and freezer liner 20 are received within the opening 16 of the wrapper 14 when assembled, such that there is a spacing between the outer surfaces of the refrigerator liner 18 and the freezer liner 20 relative to the inner surfaces of the wrapper 14. In this way, the spacing can be used to create the insulation cavity 22 (FIG. 8) that includes any desired type of insulation therein. For example, the insulation cavity 22 may be a vacuum insulated space and/or contain a vacuum insulated structure therein.

Figure 9:
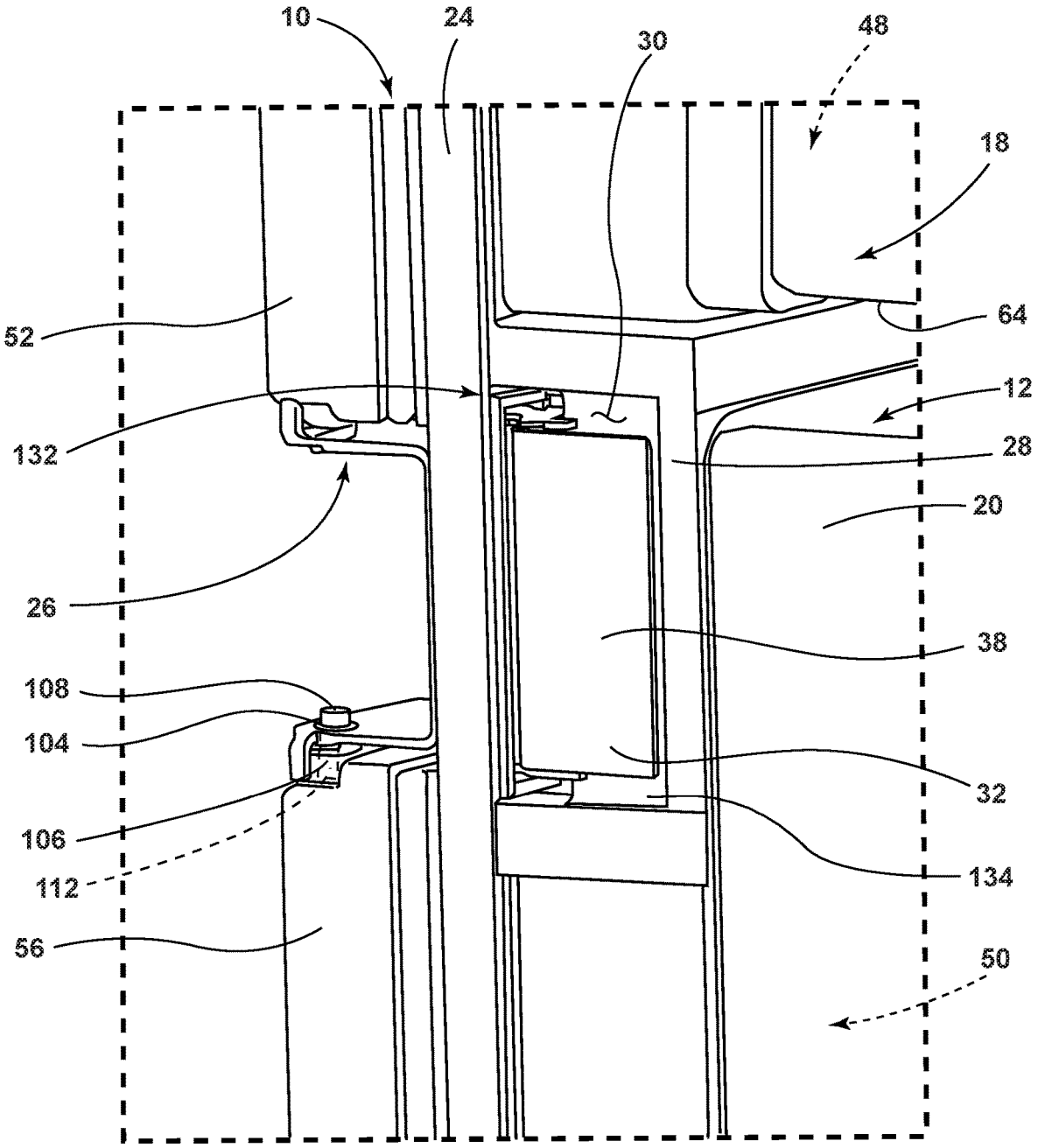
FIG. 9 is an enhanced view of area IX of FIG. 8 illustrating the first hinge support positioned within the encapsulation cavity.

The trim breaker 24 may include linear portions that are interconnected to form a ring-like structure having an outer coupling portion and an inner coupling portion (FIG. 9). It will be understood that the trim breaker 24 may have various shapes and configurations as may be required for a particular application, and it is further contemplated that the trim breaker 24 can be used in a refrigerator 10 having multiple liners (as shown in FIG. 2 with a refrigerator liner 18 and a freezer liner 20) or in a refrigerator 10 having a single liner 18, 20 for use as a refrigerator or freezer only.

The wrapper 14 may be made from sheet metal, polymer materials, or other suitable materials. If the wrapper 14 is made from sheet metal, the wrapper 14 may be formed utilizing known steel-forming tools and processes. Additionally and/or alternatively, the wrapper 14 may be formed from a polymer and/or elastomer material. For example, the wrapper 14 may be fabricated by thermoforming a sheet of thermoplastic polymer material. The wrapper 14 may be constructed of a material that may be substantially impervious, such that oxygen, nitrogen, carbon dioxide, water vapor, and/or other atmospheric gases are sealed out of the insulation cavity 22 (FIG. 8) that is formed between the wrapper 14 and liners 18, 20. If the wrapper 14 is formed from a polymer material, the polymer material may include a plurality of layers, wherein the layers of material are selected to provide impermeability to various gases.

The refrigerator liner 18 and the freezer liner 20 may be made from a sheet metal material utilizing known steel-forming tools and processes. Additionally and/or alternatively, the liners 18, 20 may otherwise be formed from a polymer and/or elastomer material in the form of a polymer sheet that is thermoformed. The polymer material may include one or more layers of material that are selected to provide impermeability to gases. The liners 18, 20 may optionally include a plurality of reinforcing structures, such as vertically spaced ridges or other forms for supporting dividers within the refrigerator compartment 48 or freezer compartment 50. Examples of layered polymer materials that may be utilized to construct the wrapper 14 or liners 18, 20 are disclosed in U.S. patent application Ser. No. 14/980,702, entitled "MULTILAYER BARRIER MATERIALS WITH PVD OR PLASMA COATING FOR VACUUM INSULATED STRUCTURE," and U.S. patent application Ser. No. 14/980,778, entitled "MULTI-LAYER GAS BARRIER MATERIALS FOR VACUUM INSULATED STRUCTURE," the entire contents of which are incorporated herein by reference. In some instances, the wrapper 14 and/or the liners 18, 20 may be thermoformed from a tri-layer sheet of polymer material including first and second outer structure layers and a central barrier layer that is positioned between the outer layers. The outer layers and the barrier layer may be formed from thermoplastic polymers. The barrier layer may optionally include an elastomeric material. The outer layers and the barrier layer may be coextruded or laminated together to form a single multi-layer sheet prior to thermoforming.

When the insulated cabinet structure 12 is assembled, the trim breaker 24 connects to the front edge portion 102 of the wrapper 14, to the front edge portion 74 of the refrigerator liner 18 and to the front edge portion 90 of the freezer liner 20 to thereby interconnect the wrapper 14 and the liners 18, 20 into a composite structure. The trim breaker 24 may be formed from a suitable material that is substantially impervious to gases to maintain a vacuum in the insulation cavity 22. The trim breaker 24 may also have a low coefficient of thermal conductivity to reduce or prevent the transfer of heat between the wrapper 14 and the liners 18, 20. In various examples, the trim breaker 24 may be formed utilizing a molding process, such as a reaction injection molding (RIM) process. In a RIM process, the trim breaker 24 is formed in a mold using a polyurethane material. Other materials suitable for a RIM process may include but are not limited to, polyureas, polyisocyanurates, polyesters, polyphenols, polyepoxides, thermoplastic elastomers, polycarbonate, and nylon materials. In some examples, the trim breaker 24 is overmolded to the refrigerator liner 18, the freezer liner 20 and the wrapper 14. In this way, the insulated cabinet structure 12 can be a unitary part after the trim breaker 24 is cast onto the liners 18, 20 and the wrapper 14.

When the refrigerator 10 (FIG. 1) is in use, the wrapper 14 is exposed to ambient room temperature air, whereas the liners 18, 20 are generally exposed to refrigerated air in the refrigerator compartment 48 or the freezer compartment 50. With the trim breaker 24 being made of a material that is minimally conductive, and/or substantially non-conductive, with respect to heat, the trim breaker 24 reduces the transfer of heat from the wrapper 14 to the liners 18, 20 thereby forming at least one temperature-controlled compartment 48, 50.

Referring now to FIGS. 3-7, the center portion of the trim breaker 24, or a mullion, may be positioned between the refrigerator compartment 48 and the freezer compartment 50. A cover assembly 95 may be positioned outwardly of the mullion to partially and/or fully conceal portions of the mullion. The cover assembly 95 may be coupled to the trim breaker 24, or the mullion, through one or more fasteners 97. However, the cover assembly 95 may be coupled to the trim breaker 24, or the mullion, through any other assembly without departing from the teachings provided herein. In some examples, the cover assembly 95 and trim breaker 24 may be integrally formed with one another 24, 95.

The first hinge bracket 26 may support a first hinge 86 that may be operably coupled with the cover assembly 95 and/or trim breaker 24 and may be generally provided laterally outward of a centerline of the refrigerator 10. The first hinge bracket 26 may also be proximate the central portion of the trim breaker 24, positioned in a vertically intermediate position along the trim breaker 24, and/or between the refrigerator compartment 48 and the freezer compartment 50. A second hinge 88 may be positioned on an opposing side of the temperature-controlled compartment 48, 50 from the first hinge 86 and the first hinge bracket 26. The second hinge 88 (FIG. 12) may be positioned proximate a top portion of the cabinet structure 12 and/or a bottom portion of the cabinet structure 12 to support a door 52, 54, 56 (FIG. 1) that is pivotably coupled to the cabinet structure 12. Accordingly, an upper and/or a lower door 52, 54, 56 may be supported by one or more first hinges 86 and respective second hinges 88. It will be appreciated that more than one first hinge 86 may be positioned on the central portion of the cabinet structure 12 with one first hinge 86 supporting an upper door 52, 54 and another first hinge 86 supporting the lower door 56. Alternatively, the upper door 52, 54 or the lower door 56 may be supported by the first and second hinges 86, 88 to allow for the upper door 52, 54 or the lower door 56 to rotate between an open and a closed position while the other of the upper door 52, 54 or the lower door 56 is supported by a track assembly that allows the respective door 52, 54, 56 to slide from a closed position to an open position.

In some examples, the first hinge 86 may be positioned in a position that conceals one or more fasteners 97 that retain the cover assembly 95. In some examples, the remaining fasteners 97 that are not aligned with the first hinge 86 may have concealers thereon to assist in obscuring the one or more cover assembly fasteners 97.

Figure 4:
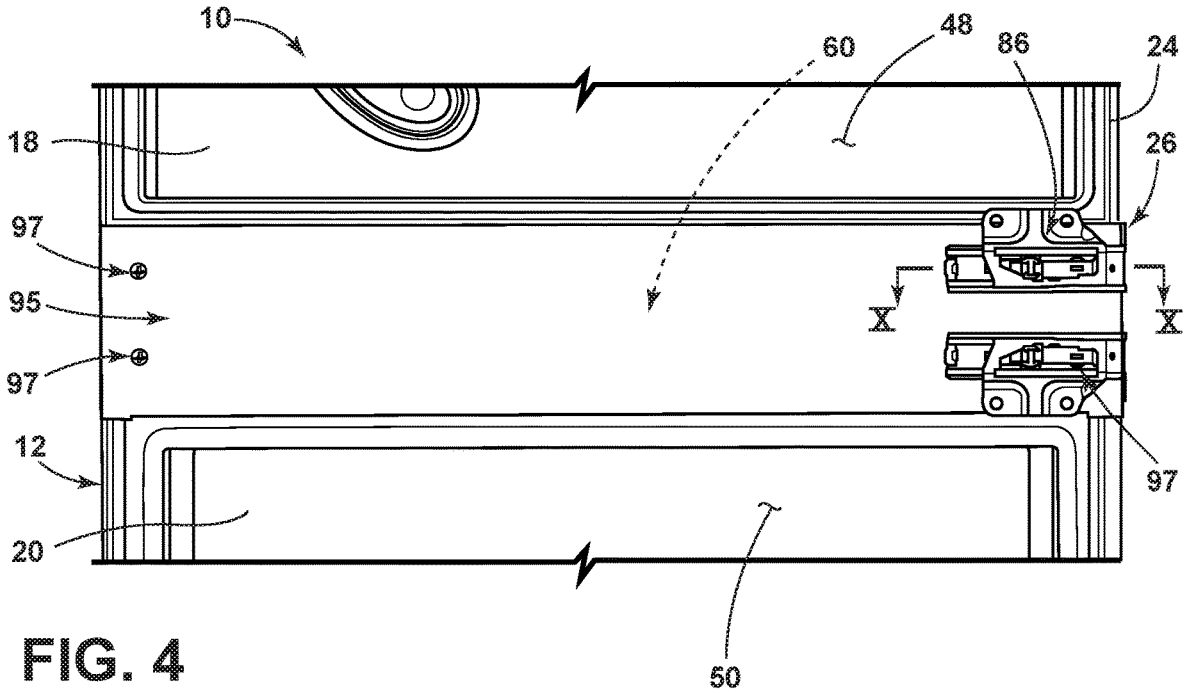
FIG. 4 is a front plan view of the trim breaker and a hinge bracket, according to some examples.
Figure 5:
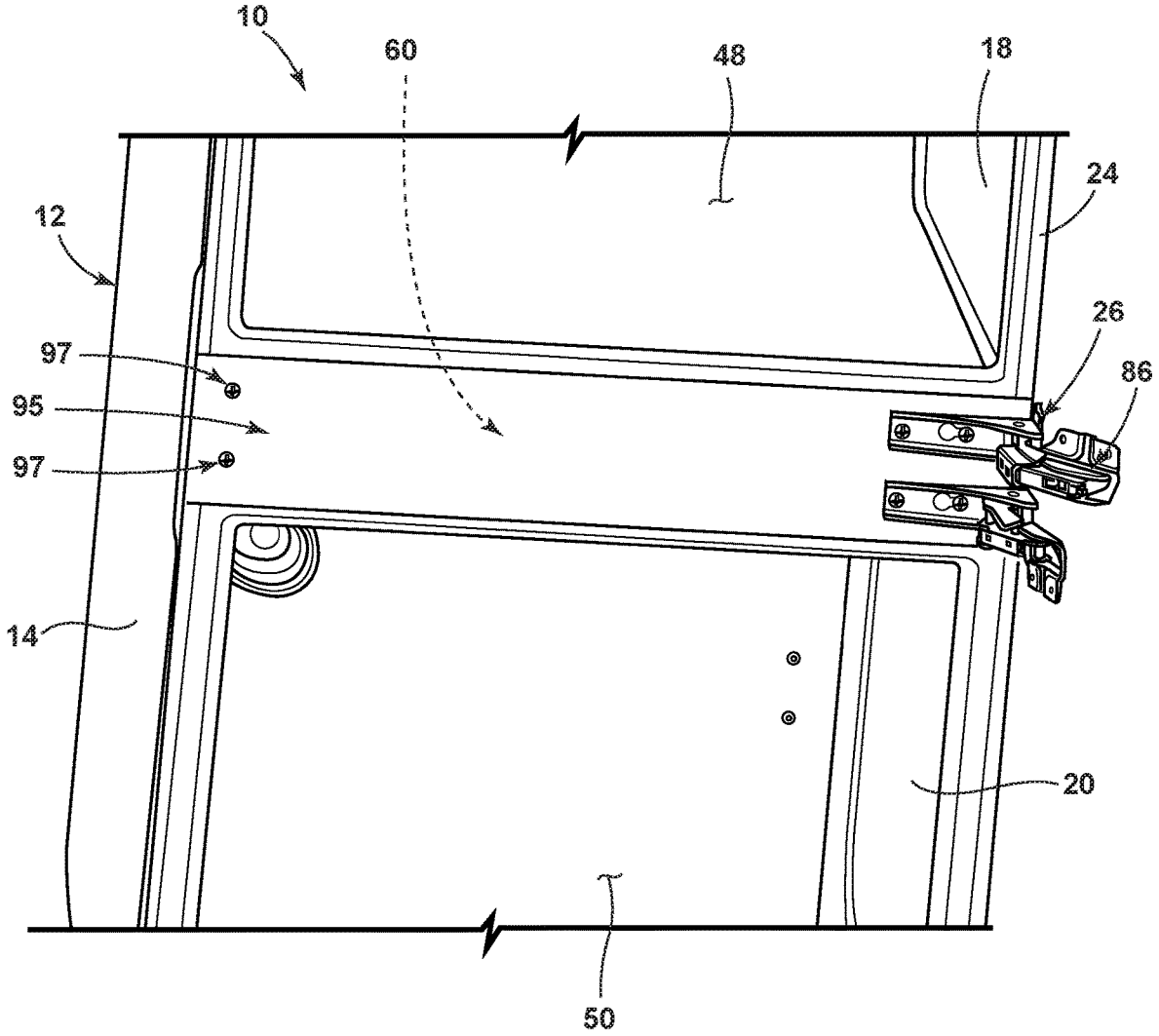
FIG. 5 is a front perspective view of the hinge bracket supporting an articulating hinge, according to some examples.
Figure 6:
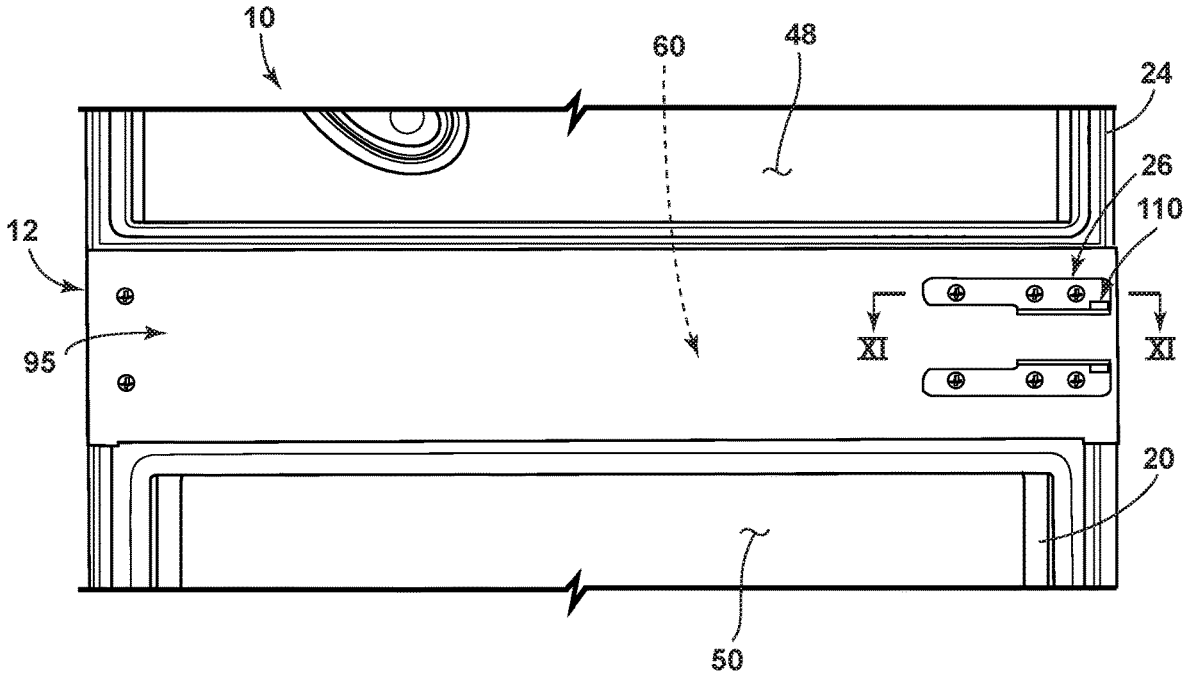
FIG. 6 is a front plan view of the hinge bracket defining a hinge pin opening, according to some examples.
Figure 7:
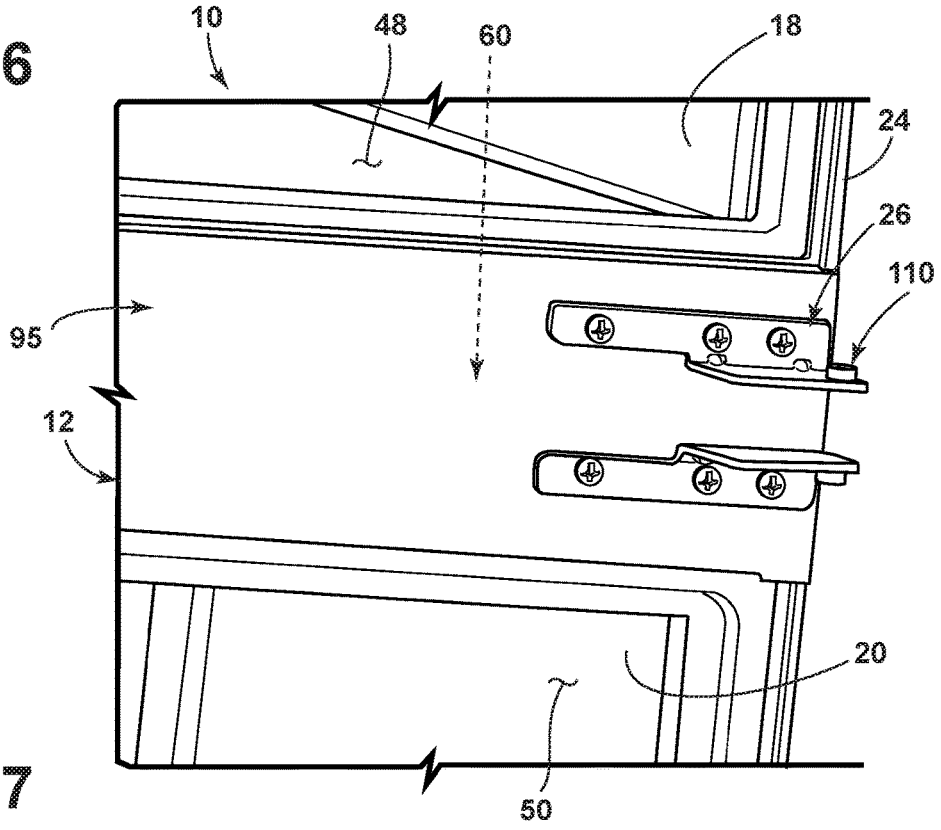
FIG. 7 is a front perspective view of the hinge bracket defining the hinge pin opening, according to some examples.

Referring to FIGS. 4 and 5, the first hinge 86 is illustrated in a contracted position (FIG. 4) and an expanded position (FIG. 5). When the refrigerator 10 is assembled, the contracted position places the door 52, 54, 56 in the closed position. The expanded position places the door 52, 54, 56 in the open position. The first hinge 86 and/or the second hinge 88 (FIG. 12) may also be placed in a plurality of intermediate positions between the contracted and expanded positions. In some examples, the first hinge 86 and/or the second hinge 88 may be configured as a six-link mechanism. For example, according to some examples, the first hinge 86 and/or the second hinge 88 may include a Watt's six-link mechanism for movement. The selection of a Watt's six-link mechanism allows for a wide-open position and/or a large range of motion, although other link isomers and link variations may be selected without departing from the scope of the present disclosure. Accordingly, as the door 52, 54, 56 moves from a closed position, as illustrated in FIG. 4, to an open position, as illustrated in FIG. 5, the first and/or second hinge 86, 88 may rotate and/or translate the door 52, 54, 56 laterally outward of the cabinet structure 12.

Referring to FIGS. 6-9, the first and second hinges 86, 88 may additionally and/or alternatively include respective hinge pins 104 that may be coupled to each hinge bracket 26, 40. A corresponding mounting block 106 may be coupled with the door 52, 54, 56. The hinge pin 104 may have a first end portion 108 that is inserted into a cavity 110 defined by the first and/or second hinge brackets 26, 40. A second end portion 112 of the hinge pin 104 may be inserted into the mounting block 106. The mounting block 106 may be positioned externally from an insulating cavity of the door 52, 54, 56 to maintain an insulative assembly within the door 52, 54, 56.

Figure 8:
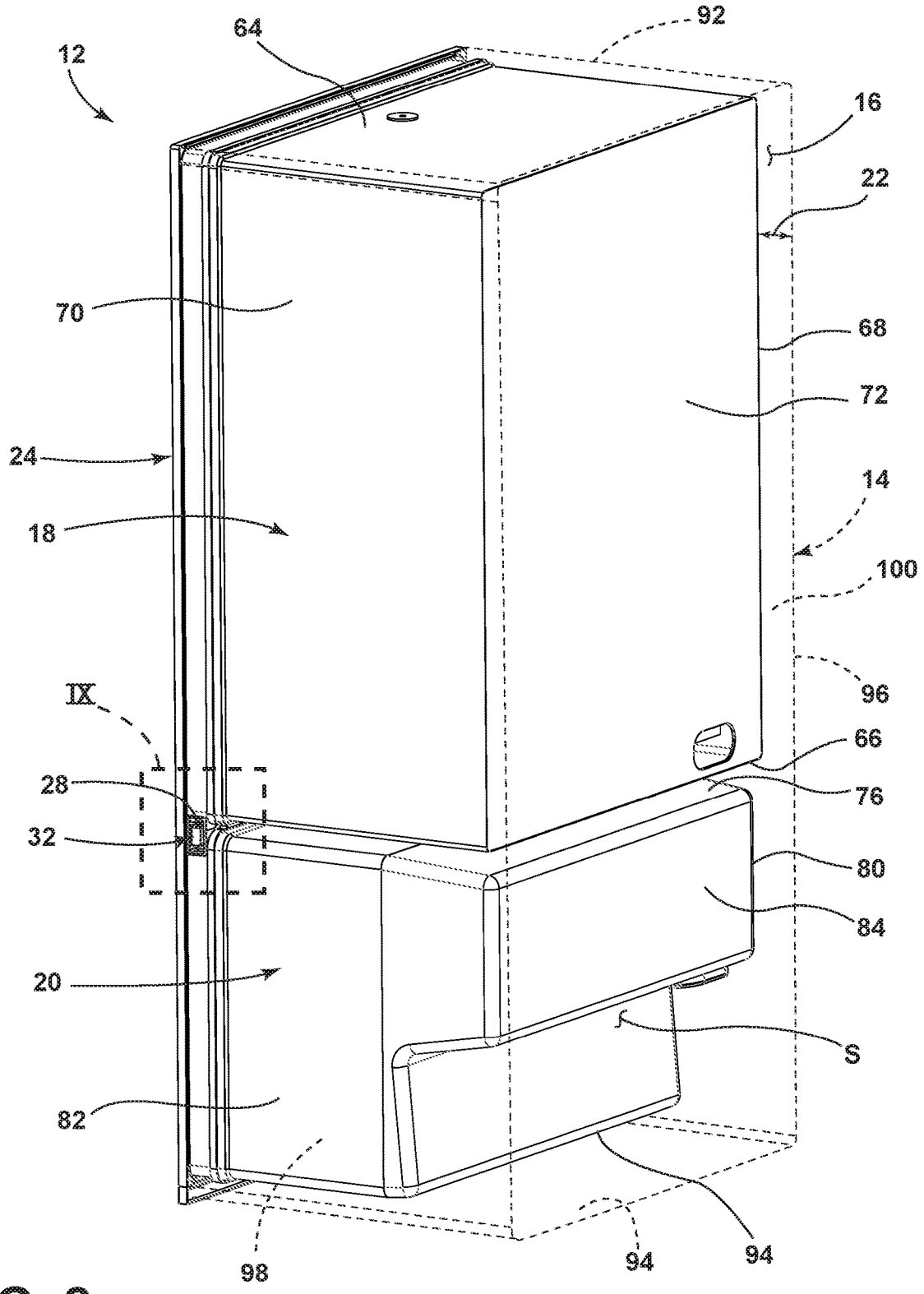
FIG. 8 is a rear perspective view of the refrigerator having a first hinge support positioned within an encapsulation cavity defined by an encapsulation member, according to some examples.

Referring to FIGS. 8 and 9, the insulation cavity 22 may be defined between the liners 18, 20 and the wrapper 14. The insulation cavity 22 is configured to receive an insulating material that may be configured as a vacuum core material. The vacuum core material may include a plurality of individual core panels that are preformed and positioned between the wrapper 14 and the liners 18, 20. Alternatively, the vacuum core material may include silica powder or other suitable loose filler material that is inserted (e.g. blown) into the insulation cavity 22 after the wrapper 14, the liners 18, 20, and the trim breaker 24 are formed into a unitary composite structure. In vacuum insulated structures, a vacuum within the insulation cavity 22 decreases heat transmission through the insulation cavity 22. By creating a vacuum between the spaces intended to be thermally isolated, heat conduction is minimized because there is no, or less, material (e.g., air) to transfer the thermal energy between the thermally isolated spaces. In some instances, the insulation cavity 22 may have an air pressure of less than about 1 atm, about 0.5 atm, about 0.4 atm, about 0.3 atm, about 0.2 atm, about 0.1 atm, or less than about 0.01 atm.

Referring to FIGS. 8 and 9, a first hinge support 32 may be positioned between a portion of the trim breaker 24 and the refrigerator compartment 48 and/or the freezer compartment 50. The first section 34 (FIG. 10) of the first hinge support 32 may be positioned along the second hinge support 36 and a second section 38 extends rearwardly of the first section 34. In some instances, the second section 38 of the first hinge support 32 may couple to or otherwise contact the wrapper 14 and/or the liners 18, 20 of the cabinet structure 12. The first hinge support 32 is configured to support the hinge bracket, and consequently, the door 52, 54, 56 that is operably coupled with the hinge bracket.

With reference to FIGS. 8-11, the encapsulation member 28 is disposed around a portion of the first hinge support 32. In various examples, the encapsulation member 28 may have any desired shape. For example, as illustrated, the encapsulation member 28 has a first portion 114 that is separated from the first hinge support 32 by a first distance $d_1$ to accommodate a portion of a first fastener 120 therein. A second portion 116 of the encapsulation member 28 may extend rearwardly along the side portion of the wrapper 14 in a direction that is parallel to the second section 38 of the first hinge support 32. The second portion 116 may be disposed a second distance $d_2$ from the wrapper 14. A third portion 118 of the encapsulation member 28 may couple with the wrapper 14 at a position that is rearward of the first hinge support 32. As provided herein, the encapsulation member 28 may define the encapsulation cavity 30 that is impervious to the insulation cavity 22 such that oxygen, nitrogen, carbon dioxide, water vapor, and/or other atmospheric gases are sealed out of the insulation cavity 22. Thus, the first fastener 120 may be positioned within the encapsulation cavity 30 and the insulation structure, which is possibly a vacuum insulated structure, may maintain its integrity after insertion of the first fastener 120.

The encapsulation member 28 may be made from a sheet metal material utilizing known steel-forming tools and processes. Additionally and/or alternatively, the encapsulation member 28 may otherwise be formed from a polymer and/or elastomer material in the form of a polymer sheet that is thermoformed. The polymer material may include one or more layers of material that are selected to provide impermeability to gases. The encapsulation member 28 may optionally include a plurality of reinforcing structures, such as vertically spaced ridges or other forms. Additionally, and/or alternatively, the encapsulation member 28 may be integrally formed within the trim breaker 24 and/or the wrapper 14.

Figure 10:
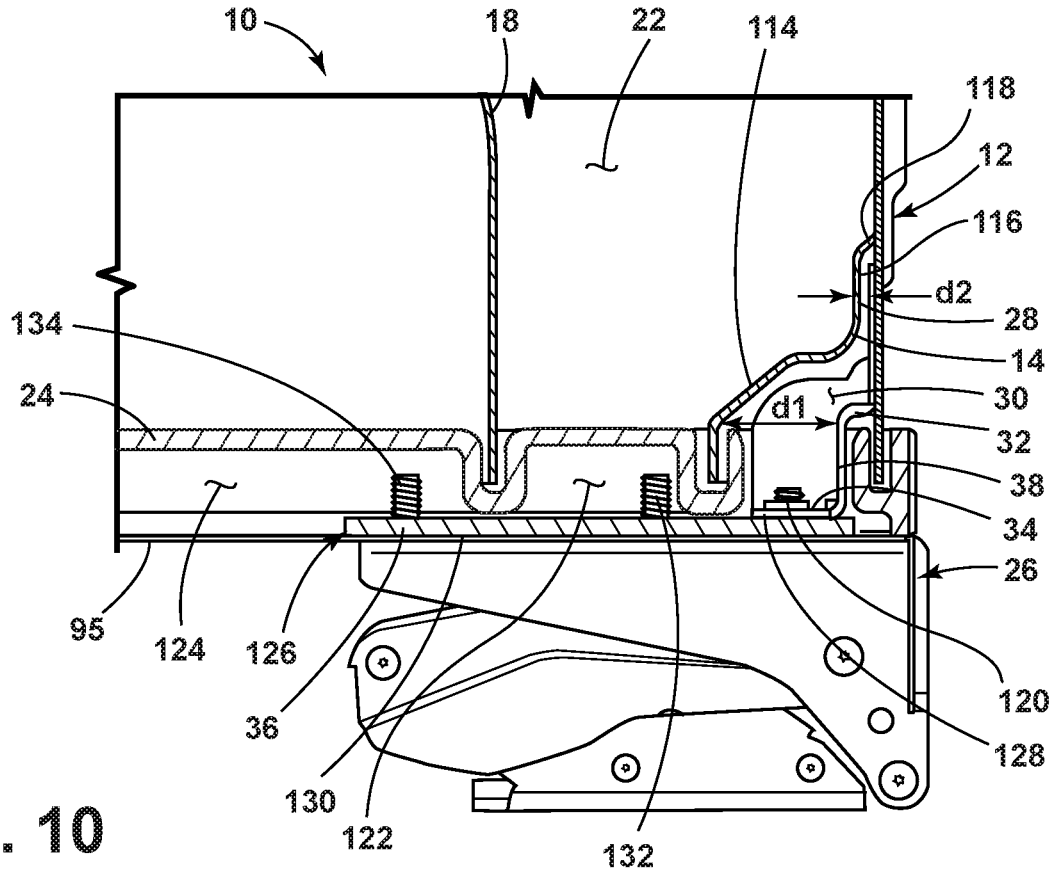
FIG. 10 is a cross-sectional view of the refrigerator cabinet structure of FIG. 4 taken along the line X-X.
Figure 11:
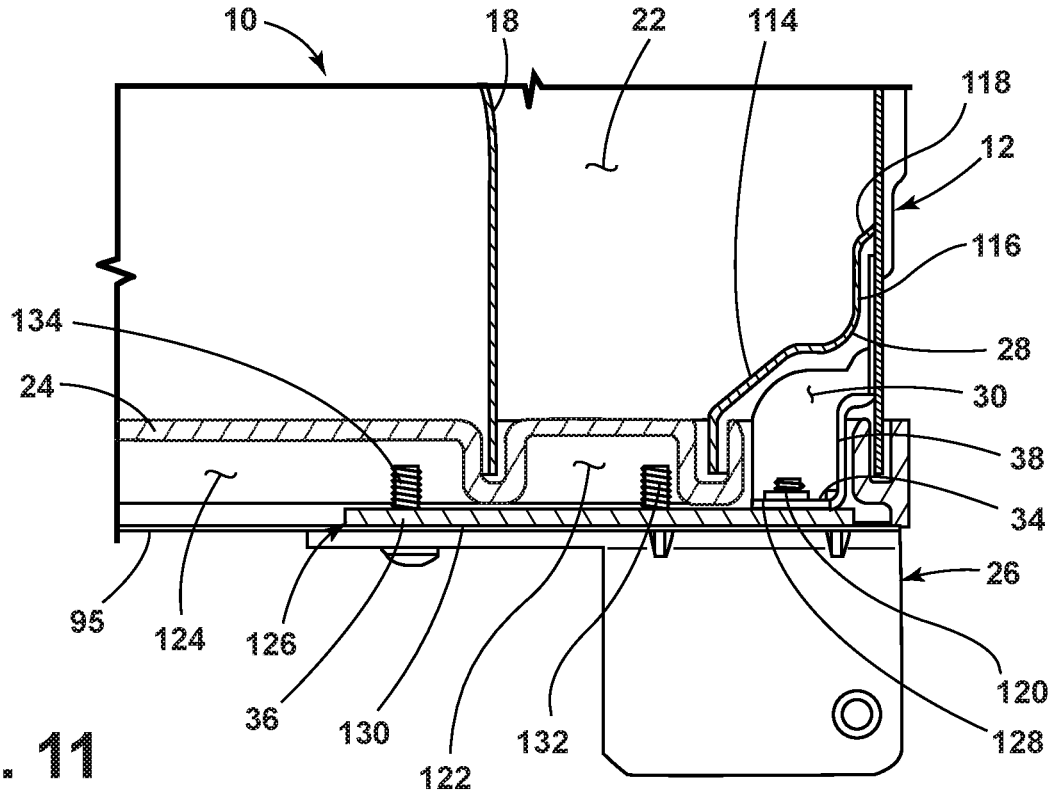
FIG. 11 is a cross-sectional view of the refrigerator cabinet structure of FIG. 6 taken along the line XI-XI.

As illustrated in FIGS. 10 and 11, the encapsulation member 28 may be coupled to the trim breaker 24. Accordingly, the trim breaker 24, the encapsulation member 28, and the wrapper 14 may define the encapsulation cavity 30. The trim breaker 24 may further define one or more trim breaker cavities 122, 124. In some instances, a first trim breaker cavity 122 may be positioned laterally inward from the encapsulation member 28 and a second trim breaker cavity 124 may be positioned laterally inward of the first trim breaker cavity 122. The cavities 122, 124 defined by the trim breaker 24 may be impervious to the insulation cavity 22 such that oxygen, nitrogen, carbon dioxide, water vapor, and/or other atmospheric gases are sealed out of the insulation cavity 22. Thus, when fasteners 132, 134 are positioned within the one or more trim breaker cavities 122, 124, the insulation cavity 22, which is possibly a vacuum insulated structure, may maintain its integrity.

The trim breaker 24 may also define an opening 126 and the second hinge support 36 may be disposed within the opening 126. However, in other examples, the second hinge support 36 may be positioned forwardly and/or rearwardly of the trim breaker 24 without departing from the teachings of the present disclosure. The second hinge support 36 may extend at least partially in front of the encapsulation cavity 30, the first trim breaker cavity 122, and/or the second trim breaker cavity 124.

Referring still to FIGS. 10 and 11, the first hinge bracket 26 may have the first fastener 120 inserted therethrough that is further inserted through the cover assembly 95, the second hinge support 36, and/or the first hinge support 32. Accordingly, in some instances, the first hinge support 32 may be coupled to an inner surface 128 of the second hinge support 36. Additionally, the hinge bracket 26 is positioned proximately to an outer side 130 of the second hinge support 36. A second fastener 132 may be inserted through the hinge bracket, the cover assembly 95, the second hinge support 36 and into the first trim breaker cavity 122. Likewise, a third fastener 134 may be positioned laterally inward of the second fastener 132 and inserted through the first hinge bracket 26, the cover assembly 95, the second hinge support 36 and into the second trim breaker cavity 124. Accordingly, the first hinge support 32 may also support the second hinge support 36. Through the use of multiple fasteners 120, 132, 134, the hinge bracket may be substantially fixed to the cabinet structure 12 of the refrigerator 10 while the door 52, 54, 56 exerts downward forces, rotational forces, and/or torsion forces on the hinge bracket, the trim breaker 24, and the cabinet structure 12.

Referring to FIGS. 12-15, the second hinge brackets 40 may each be mounted to respective braces 42 and positioned on an opposing side of the temperature-controlled compartment 48, 50 from the first hinge bracket 26. Each brace 42 may be further mounted to a plate 44 that extends along a top and/or the bottom portion of the wrapper 14. In some examples, the braces 42 and/or the plates 44 may each be formed from a metallic material, a polymeric material, a combination thereof, and/or any other practicable material. In examples in which the braces 42 and/or the plates 44 are formed from a metallic material, a stamping process may be used to form the respective component(s). In examples in which the braces 42 and/or the plates 44 are formed from a polymeric material, an injection molding process and/or a thermoforming process may be used to form the respective component(s).

Figure 12:
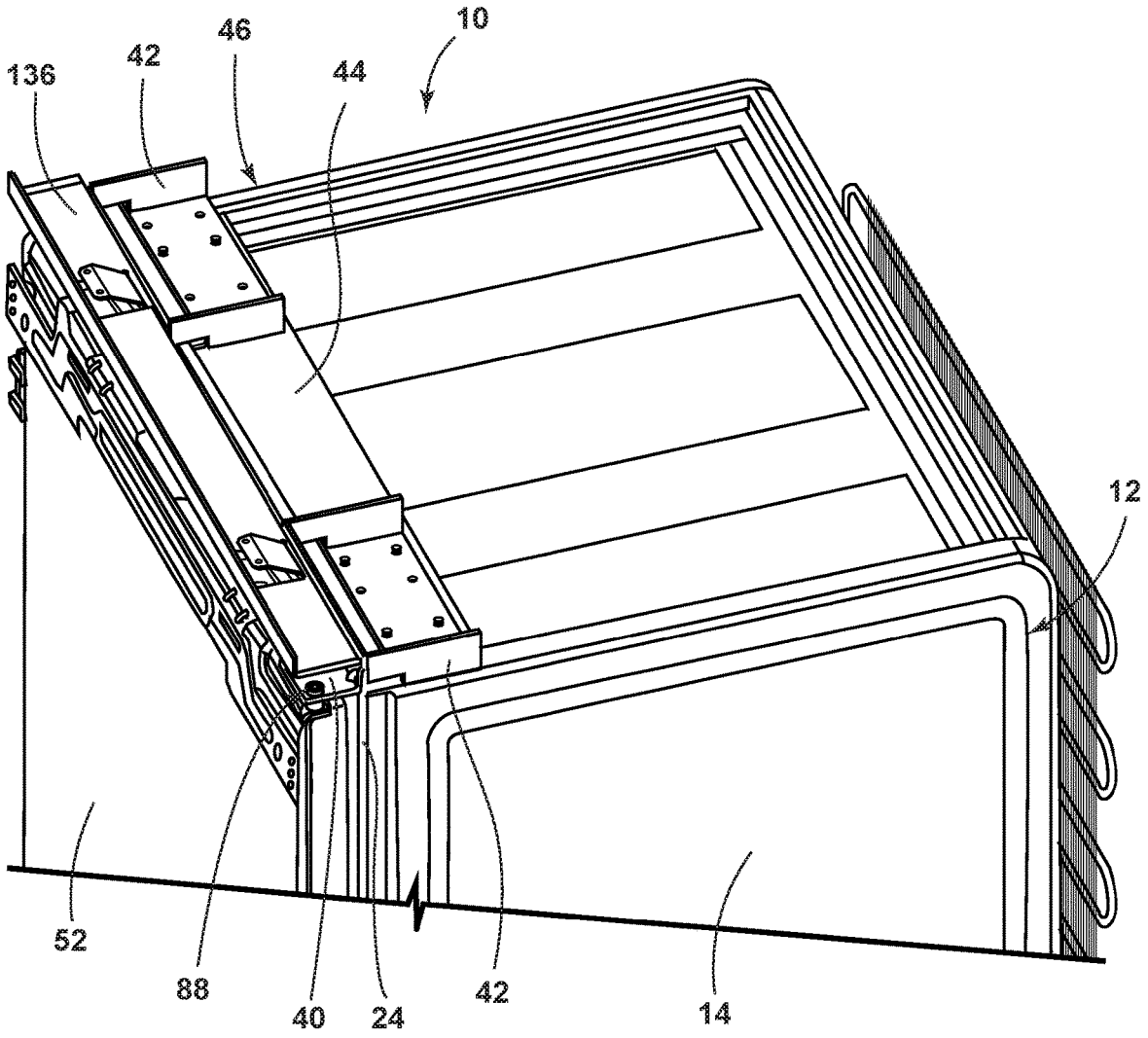
FIG. 12 is a top perspective view of the refrigerator having a top plate supporting a pair of top braces and a pair of top hinge brackets coupled with the braces, according to some examples.
Figure 13:
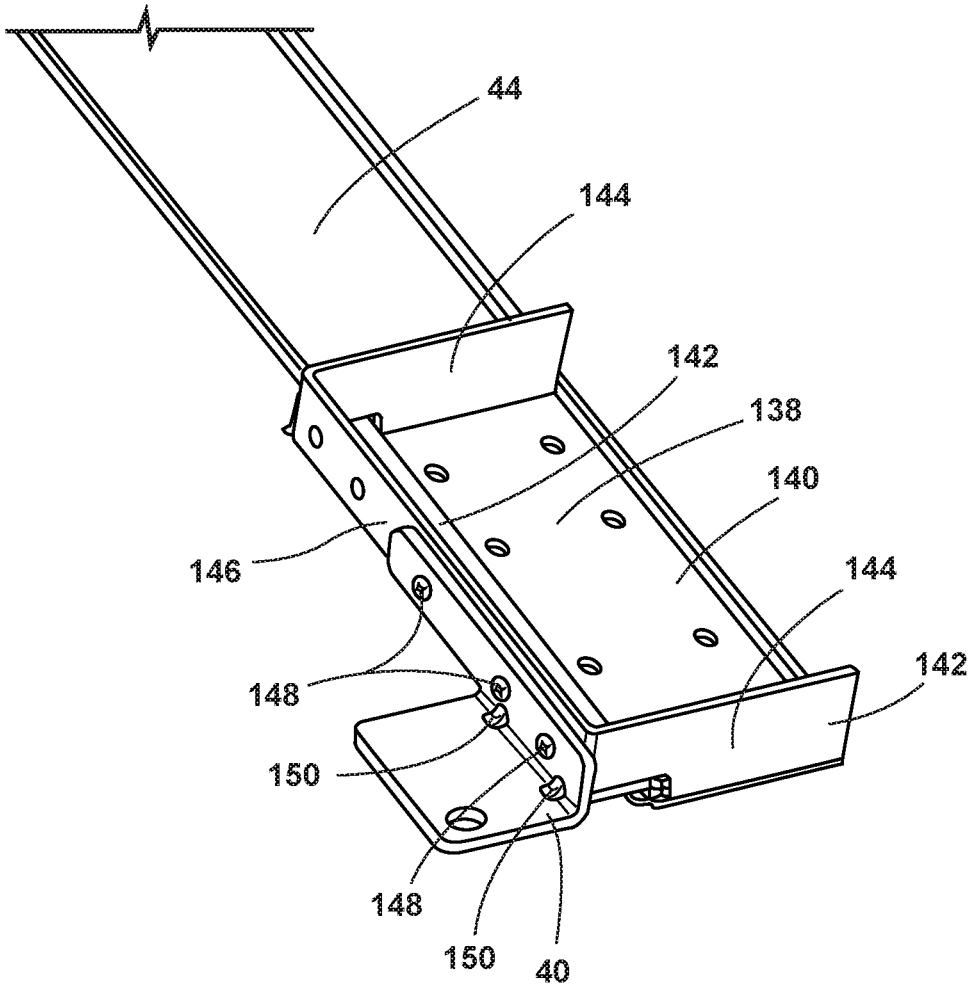
FIG. 13 is a top perspective view of the top plate supporting the pair of top braces and the pair of top hinge brackets of FIG. 12.

As illustrated in FIGS. 12 and 13, the braces 42 may be coupled with the plate 44 that is positioned along a top portion of the wrapper 14. The braces 42 may also be positioned at least partially rearward of the trim breaker 24. A locating member 136 may be positioned upwardly of the brace 42 and/or hinge bracket. The locating member 136 may be configured to attach the cabinet structure 12 to proximate cabinetry in instances in which the refrigerator 10 is configured as a built-in type of refrigerator 10.

The brace 42 that is mounted on the top portion of the cabinet structure 12 may have a base surface 138 having a stepped profile. A rearward step 140 may be positioned vertically lower than a front step 142. The brace 42 may also include a pair of side surfaces 144 and a front surface 146 that extends upwardly from the base surface 138. The front surface 146 defines one or more voids through which a fastener 148 may be positioned for coupling the hinge bracket thereto.

With further reference to FIGS. 12 and 13, the bracket may include one or more reinforcement ribs 150. The reinforcement ribs 150 may be configured to provide additional support to the hinge bracket. The reinforcement ribs 150 may be integrally formed with the hinge bracket and/or later attached thereto.

Figure 14:
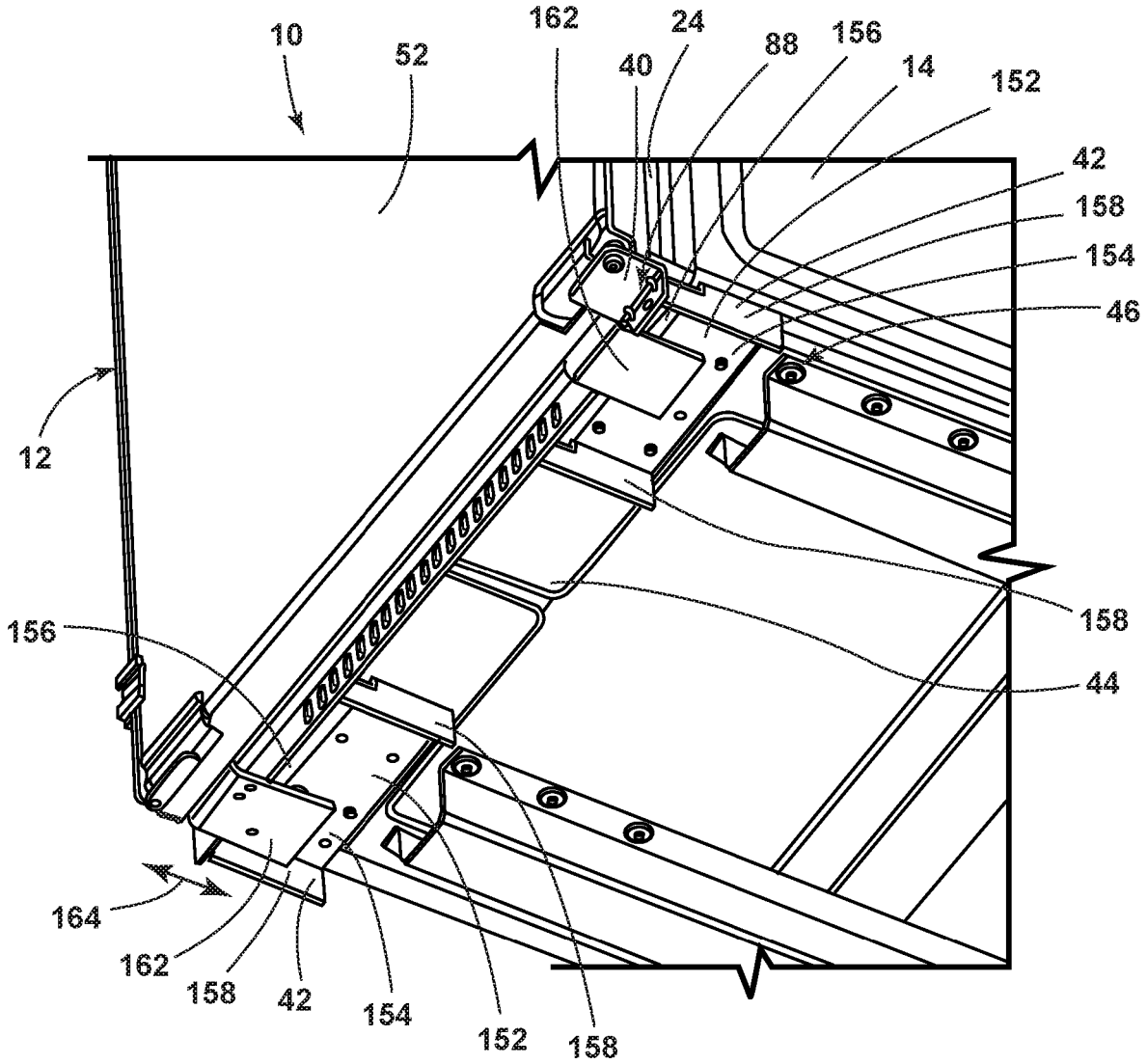
FIG. 14 is a bottom perspective view of the refrigerator having a bottom plate supporting a pair of bottom braces and a pair of bottom hinge brackets coupled with the bottom braces, according to some examples.
Figure 15:
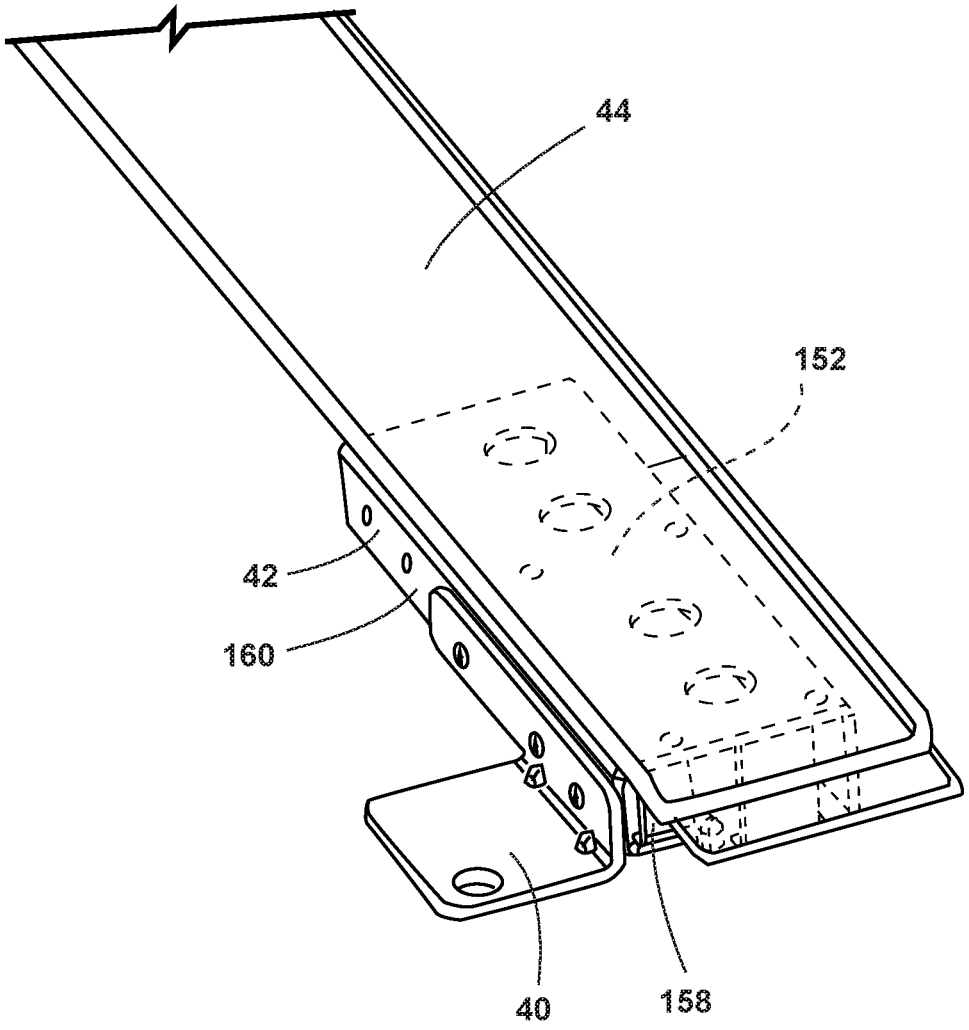
FIG. 15 is a bottom perspective view of the bottom plate supporting the pair of bottom braces and the pair of bottom hinge brackets of FIG. 14.

Referring to FIGS. 14 and 15, a brace 42 may additionally and/or alternatively be coupled with the plate 44 extending laterally across a bottom portion of the wrapper 14. In some examples, a pair of braces 42 may be positioned on opposing side portions of the plate 44. However, the plates 44 along the top and bottom portions of the wrapper 14 may each contain any number of braces 42 without departing from the scope of the present disclosure.

The brace 42 along the bottom portion of the wrapper 14 may include a base surface 152 that includes a stepped profile. A rearward step 154 may be positioned vertically above a forward step 156. The bottom brace 42 may also include a pair of side surfaces 158 and a front surface 160. The second hinge bracket 40 may be coupled to the front surface 160 and extend forwardly of the wrapper 14 and/or the trim breaker 24. The second hinge bracket 40 may support a hinge 88 having a pin 104 (FIG. 9) and/or an articulating hinge without departing from the scope of the present disclosure. The plates 44 extending along the top and bottom portions of the wrapper 14 may be positioned externally from the insulation cavity 22 such that the insulation cavity 22 is unaffected by the coupling of the second hinge brackets 40 to the cabinet structure 12.

Referring still to FIGS. 14 and 15, one or more shims 162 may be positioned on a bottom portion of the braces 42 disposed along a bottom portion of the wrapper 14. The shim 162 may be moved in a forward/rearward direction, as indicated by arrow 164, to adjust a front height of the cabinet structure 12. The shim 162 may have a chamfered profile to allow for the vertical adjustment of the cabinet structure 12.

A variety of advantages may be derived from the use of the present disclosure. For example, use of the first and/or second hinge supports provides assistance in transferring downward forces, rotational forces, and/or torsion forces provided by the door on the cabinet structure. Moreover, the encapsulation member may assist in maintaining a desired insulative efficiency within an insulation cavity after one or more fasteners are inserted thereinto. The encapsulation member may be manufactured at low costs when compared to various solutions for maintaining a vacuum within the insulation cavity. The trim breaker may also define one or more cavities that also assist in maintaining a desired insulative efficiency within an insulation cavity after one or more fasteners are inserted thereinto. The additional fasteners may also help in supporting the first hinge bracket on the cabinet structure. The refrigerator may also include an externally positioned second hinge, which may be a top and/or bottom hinge bracket, that is supported by a brace positioned proximate a top and/or bottom portion of the wrapper. The braces positioned along a top and/or bottom portion of the wrapper may be fixed to a plate that extends laterally across the wrapper of the refrigerator. The braces positioned along a top and/or bottom portion of the wrapper and the plate support the second brackets such that the second hinge brackets also may not compromise a desired insulative efficiency within an insulation cavity of the cabinet structure.

It will be understood by one having ordinary skill in the art that construction of the described invention and other components is not limited to any specific material. Other exemplary examples of the invention disclosed herein may be formed from a wide variety of materials unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

Furthermore, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected" or "operably coupled" to each other to achieve the desired functionality, and any two components capable of being so associated can also be viewed as being "operably couplable" to each other to achieve the desired functionality. Some examples of operably couplable include, but are not limited to, physically mateable and/or physically interacting components and/or wirelessly interactable and/or wirelessly interacting components and/or logically interacting and/or logically interactable components. Furthermore, it will be understood that a component preceding the term "of the" may be positioned at any practicable location (e.g., on, within, and/or externally positioned from the appliance) such that the component may function in any manner described herein.

It is also important to note that the construction and arrangement of the elements of the invention as shown in the exemplary examples is illustrative only. Although only a few examples of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connectors or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary examples without departing from the spirit of the present innovations.

It will be understood that any described processes or steps within described processes may be combined with other disclosed processes or steps to form structures within the scope of the present invention. The exemplary structures and processes disclosed herein are for illustrative purposes and are not to be construed as limiting.

It is also to be understood that variations and modifications can be made on the aforementioned structures and methods without departing from the concepts of the present invention, and further it is to be understood that such concepts are intended to be covered by the following claims unless these claims by their language expressly state otherwise.

What is claimed is:

1. A cabinet structure, comprising:

a wrapper defining an opening;

a liner positioned inside the opening of the wrapper and defining a temperature-controlled compartment, wherein a vacuum insulated cavity is defined by the wrapper and the liner;

a trim breaker coupled to the wrapper and the liner;

a first hinge bracket positioned outwardly of the trim breaker;

an encapsulation member disposed rearwardly of the trim breaker and defining an encapsulation cavity;

a first hinge support having a first section positioned along a second hinge support and a second section extending rearwardly from the first section, wherein the first hinge bracket is coupled to the first and second hinge supports; and an opening defined by the trim breaker, wherein the second hinge support is positioned within the opening.

2. The cabinet structure of claim 1, wherein the trim breaker defines one or more trim breaker cavities, the one or more trim breaker cavities positioned laterally inward from the encapsulation cavity.

3. The cabinet structure of claim 1, further comprising:

a door having a mounting block thereon; and a hinge pin positioned between the first hinge bracket and the mounting block.

4. The cabinet structure of claim 1, wherein the first hinge support is coupled to an inner surface of the second hinge support.

5. The cabinet structure of claim 1, wherein the first hinge bracket is positioned in a vertically intermediate position along the trim breaker.

6. The cabinet structure of claim 1, further comprising:

a second hinge bracket positioned on an opposing side of the temperature-controlled compartment, the second hinge bracket operably coupled with an externally positioned brace.

7. The cabinet structure of claim 6, wherein the brace is fixed to a plate, the plate extending laterally across an exterior portion of the wrapper.

* * * * *